US005888025A

United States Patent [19]

Papousek

[11] Patent Number: 5,888,025

[45] Date of Patent: Mar. 30, 1999

[54] COUPLING FOR TIE RODS

[75] Inventor: Herbert jun Papousek, Millstatt, Austria

[73] Assignee: Mai Pump Austria GmbH, Feistritz/Drau, Austria

[21] Appl. No.: 836,383

[22] PCT Filed: Nov. 25, 1994

[86] PCT No.: PCT/AT94/00177

§ 371 Date: May 7, 1997

§ 102(e) Date: May 7, 1997

[87] PCT Pub. No.: WO96/17153

PCT Pub. Date: Jun. 6, 1996

[51] Int. Cl.[6] ..... E21D 20/00; B25G 3/00

[52] U.S. Cl. ..... 405/259.5; 175/320; 403/307; 405/262

[58] Field of Search ..... 405/259.1, 259.5, 405/262; 403/307, 343; 173/132; 175/320, 325.2, 325.5, 325.6

[56] References Cited

U.S. PATENT DOCUMENTS

| | | | |
|---|---|---|---|
| 49,386 | 8/1865 | Cross | 403/307 X |
| 1,642,183 | 9/1927 | Thurston | 403/307 |
| 3,306,051 | 2/1967 | Howlett | 405/259.5 |
| 3,336,758 | 8/1967 | Williams | 405/259.5 |
| 3,507,121 | 4/1970 | Morfeldt | 405/259.5 |
| 3,567,254 | 3/1971 | Parssinen . | |
| 3,645,570 | 2/1972 | Johansson et al. | 405/307 |
| 4,040,756 | 8/1977 | Donegan | 403/307 |
| 4,143,986 | 3/1979 | Antosh | 403/307 |
| 4,687,368 | 8/1987 | Eklof et al. | 403/307 X |
| 4,760,887 | 8/1988 | Jansson et al. . | |
| 5,031,370 | 7/1991 | Jewett | 403/307 X |

FOREIGN PATENT DOCUMENTS

| | | | |
|---|---|---|---|
| 0 187 628 | 7/1986 | European Pat. Off. . | |
| 0 391 119 | 10/1990 | European Pat. Off. . | |
| 1 483 840 | 3/1970 | Germany . | |
| 3 700 758 | 7/1988 | Germany . | |
| 383 299 | 12/1964 | Switzerland . | |
| 1546253 | 5/1979 | United Kingdom | 403/307 |

*Primary Examiner*—Dennis L. Taylor
*Attorney, Agent, or Firm*—Young & Thompson

[57] ABSTRACT

For coupling anchor bars (2) of injection anchors, the anchor bars are screwed with their outer threads (4) into a coupling sleeve (1) provided with a corresponding inner thread (5). One of the two anchor bars (2) screwed into the coupling sleeve (1) has a chamfered surface (8) formed by an end chamfer and lies on a break (6) of the inner thread (5) of the coupling sleeve (1). The second anchor bar (2) is screwed into the coupling sleeve (1) until its end face (9) lies completely on the end face (9) of the other anchor bar (2). This ensures an advantageous transmission of forces during drilling and prevents the coupling sleeve (1) from turning during drilling.

5 Claims, 1 Drawing Sheet

COUPLING FOR TIE RODS

FIELD OF THE INVENTION

The invention relates to a coupling for tie rods of (injection-) drilling anchors with a coupling sleeve into which the ends of tie rods that have an external thread are screwed and with their end surfaces facing each other lie adjacent to one another all over, and to limit the depth to which the tie rods are screwed into the coupling sleeve two threaded sections are provided in the latter that are offset to one another inside the coupling sleeve by a fraction of a turn.

BACKGROUND OF THE INVENTION

It is known from DE-PS 37 00 758 to connect rock anchors, drill rods and the like to one another by screw connections. For this purpose, in the known coupling, both drill rods or rock anchor parts to be connected to one another have an external thread and are connected to one another with a coupling or connecting sleeve that has a corresponding internal thread. The threads are usually round threads and are produced by forging a tube-shaped blank, and the internal thread of the sleeve is produced by an open deformation of the inside of the blank of the sleeve that corresponds to the deformation on the outside.

With such connections it is also known to limit the depth to which the tie rods can be screwed in by welding an annular disk into about the center of the coupling sleeve, an annular disk against which the tie rods lie on both sides with their front ends. This type of connection is disadvantageous to the extent that the tie rods lie adjacent to one another not directly but through the annular disk, so that in view of the high loads when being set down, especially during drilling and simultaneous boring of the injection drill bar, there are transmission losses.

From EP-A-391 119 is known a connecting element for a screw connection of automatic drilling injection anchors in which the internal thread of the coupling sleeve has two cylindrical parts lying at the ends and two bases going toward one another conically, lying about in the center of the sleeve, and on which the internal thread continues. This embodiment is disadvantageous since the tie rods, when they are screwed into the coupling sleeve, do not lie directly adjacent to one another and thus the forces occurring during drilling are only poorly transmitted.

It is known from U.S. Pat. No. 3,567,254 to provide the screwing-in depth of tie rods in coupling sleeves by a section of reduced diameter in the form of a torus (FIG. 4 of U.S. Pat. No. 3,567,254).

In the coupling for tie rods of (injection-) drilling anchors known from U.S. Pat. No. 3,567,254, a coupling sleeve is provided that has an internal thread into which the ends of tie rods that have an outer thread are screwed, and the tie rods with their end surfaces facing one another lie adjacent to one another all over.

From DE-A-14 83 840 is known a coupling for drill rods that are not hollow with the features of the introductory part of claim 1.

EP 187 628 A shows the measure of providing a bevel (tapered surface) on the exposed end of drill rods that have a threaded section at the end area. But these molded faces do not lie on the end of one of the two threaded sections in EP 187 628, so that an undefined status results.

DESCRIPTION OF THE INVENTION

The object of the invention, starting from DE-A 14 83 840, is to provide a coupling for tie rods, in particular for tie rods of injection drilling anchors, that is easy to produce and that has strength so that it can with certainty transmit the forces occurring during drilling, even when the injection drilling anchor is several tens of meters long, as is often the case.

SUMMARY OF THE INVENTION

According to the invention, this object is achieved by providing bevels on the ends of the tie rods and each beveled surface extends from the outside of the tie rods to their end surface and by having only one of the two tie rods screwed into the coupling sleeve lie with its beveled surface adjacent to the end of one of the two threaded sections of the coupling sleeve.

With the coupling according to the invention the tie rods can lie directly adjacent to one another with their end surfaces, so that a favorable transmission of forces from one tie rod to the next results without transmission losses. Nevertheless, expensive measures, such as for example the welding in of known stop rings inside the sleeves, are likewise no longer necessary. With the design of the coupling for tie rods according to the invention, an actual component that limits the screwing-in depth, such as, e.g., the torus provided in U.S. Pat. No. 3,567,254 and in DE-A 14 83 840, can be dispensed with, since the offset of the turn of both threaded sections of the coupling sleeve according to the invention limits the screwing-in depth of the tie rods.

The secureness of the end surfaces lying adjacent and the limitation of the screwing-in depth are guaranteed because, according to the invention, it is provided that the ends of the tie rods are made tapered by a bevel, and the tapered surface extends from the outside of the tie rods to their end surface, only one of the two tie rods screwed into the coupling sleeve lies with its tapered surface adjacent to the end of one of the two threaded sections. Thus a defined state of the drilling anchors coupled according to the invention is guaranteed.

It is preferred in the framework of the invention that the offset of the two threaded sections be one half turn. In most cases, this comparatively small offset is sufficient for the threaded sections.

For most applications it is advantageous if the offset of both threaded sections is located in the center of the coupling sleeve.

The production of the coupling sleeve of the coupling according to the invention is simple if the coupling sleeve is a cast part, in particular a steel cast part.

BRIEF DESCRIPTION OF THE DRAWINGS

Other details, features and advantages of the coupling according to the invention come out from the description below of a preferred embodiment of the invention. There are shown in.

DETAILED DESCRIPTION OF THE INVENTION

Figure 1:
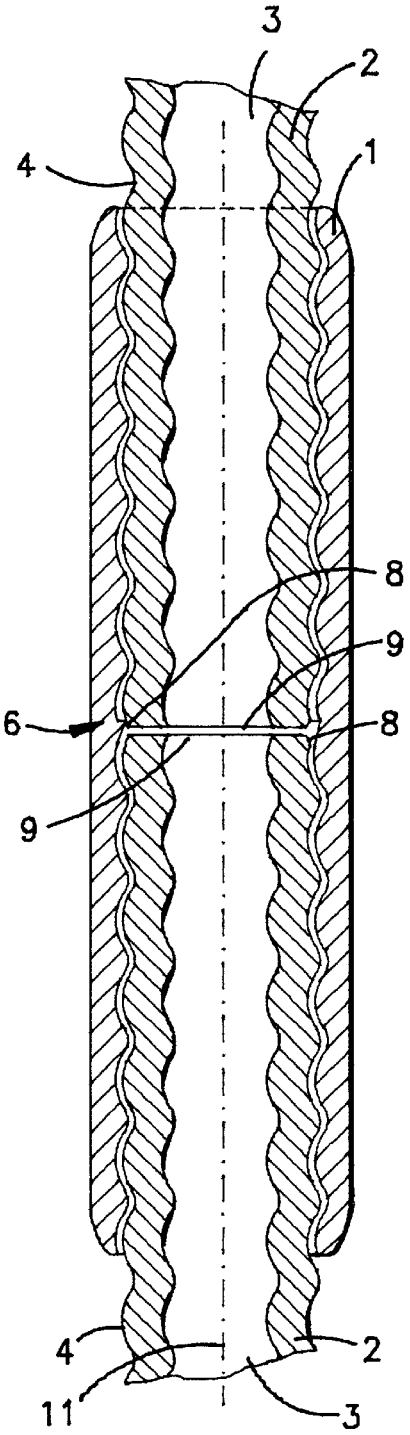
FIG. 1, in axial section, an embodiment of a coupling.

The embodiment of a coupling shown in FIG. 1 consists of a coupling sleeve 1 into which two tie rods 2 for injection drilling anchors are screwed. Tie rods 2 for injection drilling anchors are an automatic drilling anchor system whose tie rod serves as a drill rod during the drilling operation. With the connections according to the invention, anchors of almost any length can be produced. Tie rods 2 of the injection drilling anchor are hollow inside, and flushing agent is conveyed through hollow space 3 during the drilling operation and hollow space 3 serves as an injection channel for the anchor mortar when the injection drill anchor is set down.

Figure 2:
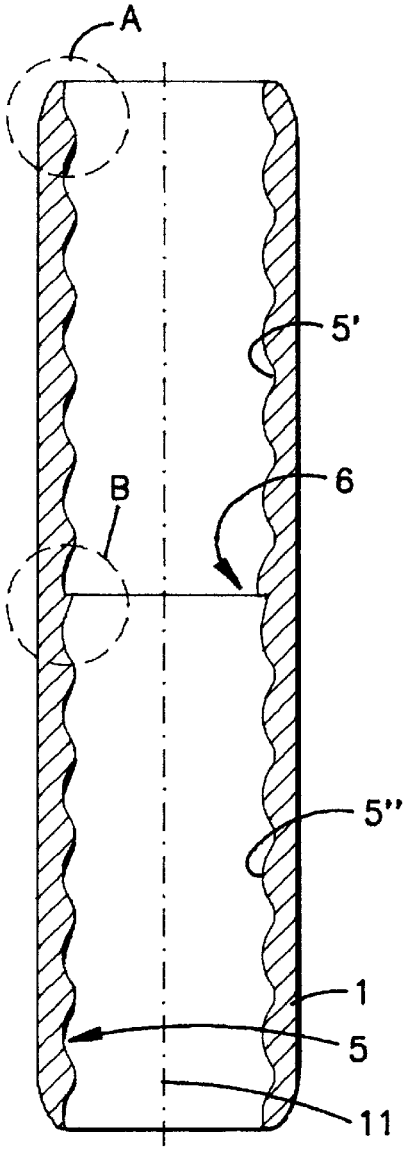
FIG. 2, the sleeve used in the coupling of FIG. 1.
Figure 4:
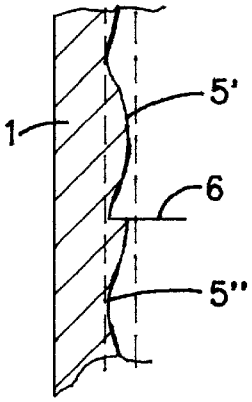
FIG. 4, a detail B of the sleeve of FIG. 2.

Tie rods 2 are high-quality pipes with continuous, cold-rolled drill rod thread 4. Coupling sleeve 1 has a corresponding internal thread 5, so that the ends of tie rods 2 can be screwed into coupling sleeve 1. As especially FIGS. 2 and 4 show, internal thread 5 of coupling sleeve 1 is interrupted about in the center of same, i.e., for example one half turn is missing, so that two threaded sections 5' and 5" result and the screwing-in depth of tie rod 2, shown on top in FIG. 1 for example, is limited, because tie rod 2 can be screwed into coupling sleeve 1 only up to interruption 6 of internal thread 5 of the latter. In the completely screwed-in state, tie rod 2 lies, with a tapered beveled surface 8 provided on its end, adjacent to interruption 6 of internal thread 5 of coupling sleeve 1. Second tie rod 2 shown below in FIG. 1 is screwed into coupling sleeve 1 until its end surface 9 lies adjacent to end surface 9 of tie rod 2 that was screwed in first.

Figure 3:
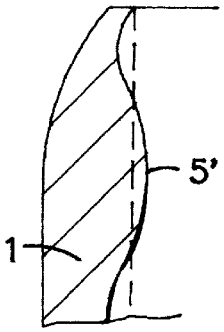
FIG. 3, a detail A of the sleeve of FIG. 2.

Coupling sleeve 1 is either a rolled pipe or, in the embodiment shown, a sleeve made of high-quality precision cast steel, and the exposed ends of coupling sleeve 1 can be made as shown in FIG. 3.

With the device according to the invention for limiting the screwing-in depth (offset threaded sections 5', 5" in coupling sleeve 1), it is prevented with tie rods 2, with their end surfaces 9 lying adjacent to one another all over, that sleeve 1 twists relative to tie rods 2 during drilling and thus the screw connection between both tie rods 2 loosens.

In summary the invention can be represented as follows:

To connect tie rods 2 of injection drill rods, the latter are screwed, with their external threads 4, into a coupling sleeve 1 having a corresponding internal thread 5. One of two tie rods 2 screwed into coupling sleeve 2 lies with a tapered surface 8, formed by a bevel on its end, adjacent to an interruption 6 in coupling sleeve 1, an interruption of internal thread 5 of coupling sleeve 1. Second tie rod 2 is screwed into coupling sleeve 1 until it lies adjacent all over, with its front face 9, to front face 9 of other tie rod 2. Thus an advantageous transmission of forces during drilling is guaranteed and coupling sleeve 1 cannot twist during drilling.

I claim:

1. A coupling arrangement, comprising:

a coupling sleeve extending in the direction of a longitudinal axis from one end to another end and including a first internal thread extending from said one end towards said another end, and a second internal thread extending from said another end towards said one end; said first internal thread being separated from said second internal thread at a thread interruption surface intermediate said one end and said another end, said thread interruption surface having a length equal to a fraction of a threaded turn;

a first tie rod extending in said direction from a first end to an opposite second end and including a first external thread extending to said first end, said first end extending into said coupling sleeve at said one end, and said first external thread mating with said first internal thread;

a second tie rod extending in said direction from a third end to an opposite fourth end and including a second external thread extending to said third end, said third end extending into said coupling sleeve at said another end, and said second external thread mating with said second internal thread;

said first end including a first bevelled surface extending from said first external thread towards said first end;

said third end including a second bevelled surface extending from said second external thread towards said third end; and at least one of said first bevelled surface and said second bevelled surface engaging said thread interruption surface.

2. The coupling arrangement according to claim 1, wherein the thread interruption surface has a length equal to half a turn.

3. The coupling arrangement according to claim 1, wherein the thread interruption surface is located in the center of the coupling sleeve.

4. The coupling arrangement according to claim 1, wherein the coupling sleeve is a cast part.

5. The coupling arrangement according to claim 1, wherein the coupling sleeve is a steel cast part.

* * * * *